United States Patent [19]

Barege

[11] Patent Number: 4,516,711

[45] Date of Patent: May 14, 1985

[54] DISPENSER FOR CONTINUOUS, SEVERABLE STRIPS

[76] Inventor: Jacqueline Barege, 2 rue de General Hoche, 31200 Toulouse, France

[21] Appl. No.: 541,038

[22] Filed: Oct. 12, 1983

[30] Foreign Application Priority Data

Oct. 13, 1982 [FR] France ..... 82 17420
Jan. 21, 1983 [FR] France ..... 83 01050

[51] Int. Cl.[3] ..... B65D 85/671

[52] U.S. Cl. ..... 225/20; 225/32; 225/52; 225/54; 225/74

[58] Field of Search ..... 225/20, 19, 32, 43, 225/51, 52, 54, 73, 74, 75, 84

[56] References Cited

U.S. PATENT DOCUMENTS 444,106 1/1891 Spraker ..... 225/32 X
2,352,445 6/1944 Pinckney ..... 225/20
2,670,041 2/1954 Krueger ..... 225/20
3,190,520 6/1965 Wyant ..... 225/73 X

*Primary Examiner*—Frank T. Yost
*Attorney, Agent, or Firm*—Harold H. Dutton, Jr.

[57] ABSTRACT

The invention concerns a dispenser of continuous, severable strips, of the kind with a case (1), a passageway (S) for the end of the strip and a cutting blade (16) provided with cutter means (16*a*). The dispenser comprises a first auxiliary blade (17) provided with a cover section (17*a*) applying friction to the strip and a stop section (17*b*) which during the severing operation is subjected to a pressure exerted by the cutting blade (16) and locks the strip at the cover section (17*a*); the dispenser also comprises a second auxiliary blade (18) protecting the cutter means (16*a*) when in the rest position and withdrawing behind the cutting blade when in the cutting position. The storage space (3) of the case can be designed to hold a continuous, accordion-folded strip.

13 Claims, 10 Drawing Figures

DISPENSER FOR CONTINUOUS, SEVERABLE STRIPS

Figure 1:
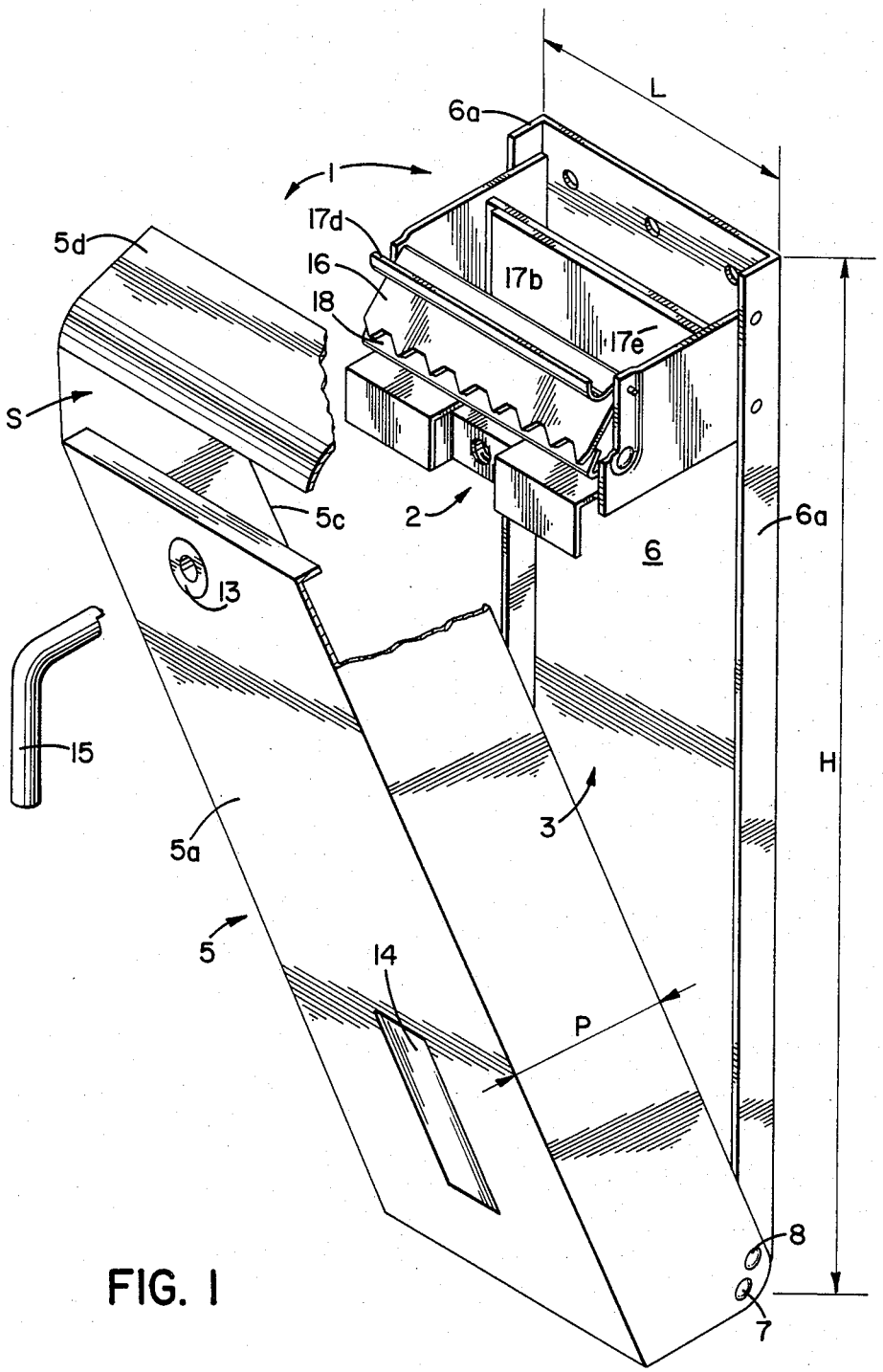

The invention concerns a dispenser for continuous, severable strips permitting to dispense desired strip lengths. At applies particularly to dispensing paper strips such as toilet paper, paper towels . . . .

Strip dispensers comprising a case housing the strip are known, wherein are provided an aperture for issuing the strip and a cutting means permitting to sever the strip after it has been pulled the desired length; the strip is severed by applying it against the cutting means and exerting on said strip a suitable sudden traction.

In order to obtain a clean cut, it is mandatory that the sudden traction exerted on the strip do not entail a slippage of the strip along the cutting means. Accordingly the British Patent No. 1,516,097 and the U.S. Pat. No. 3,040,943 provide a mobile cutting blade locking the strip when the sudden traction is applied to it. However the mobile cutting blade is provided with cutters projecting from the dispenser which turn out to be dangerous for the user, in particular for children (who may be injured in the face or the eyes considering the typical height of the dispenser opening).

It is furthermore to the point to gently brake the strip when being dispensed as the user moderately pulls on it; this gentle braking prevents the dispensing, due to inertia, of strip lengths greater than needed. Thus the U.S. Pat. No. 3,040,943, already cited, describes an independent device assuring this braking. This device is wholly independent of that locking the strip during severing because the two effects sought are totally distinct and even oppose each other, one being toward a definitive locking of the strip being cut without danger of slippage, the other exerting a gentle braking on the strip being pulled without danger of locking, so as to allow proper dispensing of the strip without either waste or tearing.

In the known devices for dispensing continuous, severable strips, the strips are stored as rolls within the dispensers; this type of packaging substantially restricts the possible capacity of a dispenser: for a cylindrical roll, two of the three dimensions necessarily are equal and using very large rolls would require dispensers with a bulk (large in the two dimensions) incompatible with installation in the typical washrooms.

The object of the present invention is to provide an improved solution to dispensing continuous, severable strips.

An essential object of the invention in particular is to provide a dispenser of simple structure and hence economical, which is capable to dispense uniformly without either waste or accidental tears, which makes possible a clean cut of the strip at the desired lengths and creates no danger at all to the user.

To that end the object of the invention, in the sense of simplification, is to provide gentle braking by means of a single member and without locking during dispensing and the definitive locking without slippage during severing.

Another object is to provide a dispenser simultaneously enjoying a compactness compatible with installation in sanitary, especially public washrooms and a considerably increased capacity with respect to the known dispensers.

Another object is to achieve, following each cut of the strip, a constant projecting length whereby to facilitate gripping the strip during the next dispensing operation and avoiding losing a grip on this strip.

Another object is to assure improved sanitary protection of the strip within the dispenser by reducing the risks of soiling it by external contact.

Another object is to provide a dispenser which can easily be loaded while being tamper-proof with respect to non-authorized personnel.

The dispenser for continuous, severable strips object of the invention is of the type comprising:

a case designed to contain the strip, a passageway for the end of said strip, a guide wall near the passageway and with an inside zone extending into the case and a sill at the exit of the case at the edge of the passageway, a cutting blade bearing cutters hinging near the passageway about a shaft designed to allow this blade to pivot between a natural rest position near the plane of said passageway, and a cutting position where its cutters are projecting beyond said passageway plane.

In the present invention, the dispenser is characterized by the combination of the following features:

a first auxiliary blade hinged about a shaft near the passageway.

this first auxiliary blade comprising a cover section extending from one side of its hinge toward the inside of the case to make contact with the inside zone of the guide wall to bound a path for the strip, this first auxiliary blade comprises a stop section arranged on the other side of its hinge so that in the cutting position, the cutting blade stops and presses against said stop section, said first auxiliary blade is so designed that in its natural rest position its cover section rests against the guide wall to brake the strip in its path and so that in the cutting position of said cutting blade said auxiliary blade be subjected by the pressure applied to its stop section to a moment assuring pinching and locking the strip by its cover section within the path, a second auxiliary blade hinges about a shaft near its passageway, this second auxiliary blade comprises a section protecting the cutters of the cutting blade, this second auxiliary blade hinges about a shaft off-set from that of the cutting blade so as to pivot between two positions: a natural rest position corresponding to the natural rest position of the cutting blade wherein the auxiliary blade passes near the sill of the guide wall and supports the cutting blade, the latter's cutters being retracted against the protection section of said auxiliary blade, and a retracted position corresponding to the cutting position of the cutting blade, wherein said auxiliary blade is located withdrawn from said cutting blade and its cutters.

Accordingly the apparatus of the invention includes three mobile blades arranged to fill the respective following functions:

The cutting blade has two functions:

in the first place it cuts at the end of its pivoting motion then it transmits to the first auxiliary blade the rupturing stress imparted to it by the strip.

The first auxiliary blade has three functions:

it provides gentle braking of the strips being dispensed, it acts as a stop for the cutting blade at the end of its pivoting motion toward the cutting position.

it locks the strip when the rupturing stress is transmitted to it.

Lastly the second auxiliary blade has two functions:

it acts as a rest for and protection to the cutting blade in its rest position, allows the cutters to assume a projecting position when the cutting blade is moving toward the cutting position.

Due to the assembly of these blades and their arrangements, the apparatus is endowed with a very simple mechanical structure; it should be noted that the opposing effects of braking and definitive locking are produced by the same member (the first auxiliary blade of which the locking depends on the position of the cutting blade).

The cutting blade can be substantially plane in manner known per se, its cutters consisting of saw-teeth in its extreme edge (opposite its hinge); the second auxiliary blade is therefore provided with a return means arranged to be situated in a plane substantially coinciding with the plane of the cutting blade in the natural rest position of said blades.

In this rest position the cutting edge of the cutting blade is therefore abutting this return means without however projecting beyond it and therefore is wholly harmless.

Furthermore, in a preferred embodiment, the passageway of the case is located in a plane substantially vertical for the normal in-use position of the dispenser. (By convention, all the qualified positions or orientations stated in this application refer to the normal in-use position of the dispenser). The various members of the dispenser in this embodiment are arranged as follows:

the guide wall is substantially horizontal, its sill being near the lower edge of the passageway, the second auxiliary blade hinges above and near the guide wall to the rear of the sill and is arranged to rest, when in its natural rest position, by its weight on the said sill, the cutting blade hinges near and above the upper edge of the passageway and is arranged to rest, in its natural rest position, against the second auxiliary blade, due to its weight, the first auxiliary blade hinges about a shaft it has in common with the second auxiliary blade and is provided with a rising junction section between its cover section and its stop section, said rising section being located behind the cutting blade and connected to the stop section above and behind the hinge shaft of the cutting blade, said stop section forming a projection toward the passageway which is located above the cutting blade.

Furthermore the cover section of the first auxiliary blade advantageously may be provided opposite the passageway with a weighted extension deviating from said guide wall; the weight is adjusted to achieve a controlled pressure of the cover section on the guide wall to assure appropriately gentle braking of the strip.

This embodiment is advantageous because of its simplicity, as the rest and gentle braking of the blades are obtained by the inherent effect of their weight without any added return means.

In another characteristic of the invention, the case is designed to form a storage space below the guide wall to hold an accordion-pleated strip.

The case therefore can advantageously assume the overall shape of a vertical elongated rectangular parallelepiped, the passageway being in the shape of a rectangular slit in the vicinity of the upper case end and extending across the entire width of one side of this case.

Therefore such a dispenser may be of comparatively small cross-section: its width slightly exceeds that of the continuous strip (in particular between 8 and 30 cm depending on the application) and its depth—corresponding to the distance separating the pleats of the strip—can be flexibly adjusted depending on the application whereby the case projects acceptably from the support holding it (in particular the depth can range approximately from 6 to 20 cm); the dispenser capacity may be very large merely by providing a suitable height for it. This height easily can reach 1.5 m without raising practical difficulties regarding installation due to the elongated, narrow and shallow shape of the dispenser, so that it can be housed in practice very conveniently in washroom facilities open to the public (movies, restaurants, railway stations, airports, hotels, private or public assembly facilities).

Therefore it is possible to store substantial strip lengths in the dispenser (easily 800 and even 1,000 meters), which cannot be done at all with the conventional roll dispensers (which would require entirely prohibitive diameters). Illustratively the largest roll dispensers for washrooms can store between 130 and 140 m of paper-towel strip.

This substantial increase in the possible capacity represents an essential advantage in practice because making possible to reduce the filling frequency and the cost of unit length in the strip (due to economies of scale). Moreover the strips in the form of rectangular parallelepipeds are easier to store than the bulky cylindrical rolls.

Other features, objects and advantages of the invention will become clear in relation to the description below and the attached drawings which illustratively and without thereby implying limitation represent one embodiment.

Figure 2A:
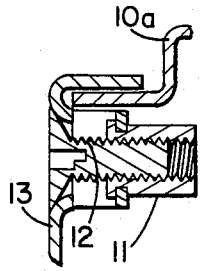
Figure 2:
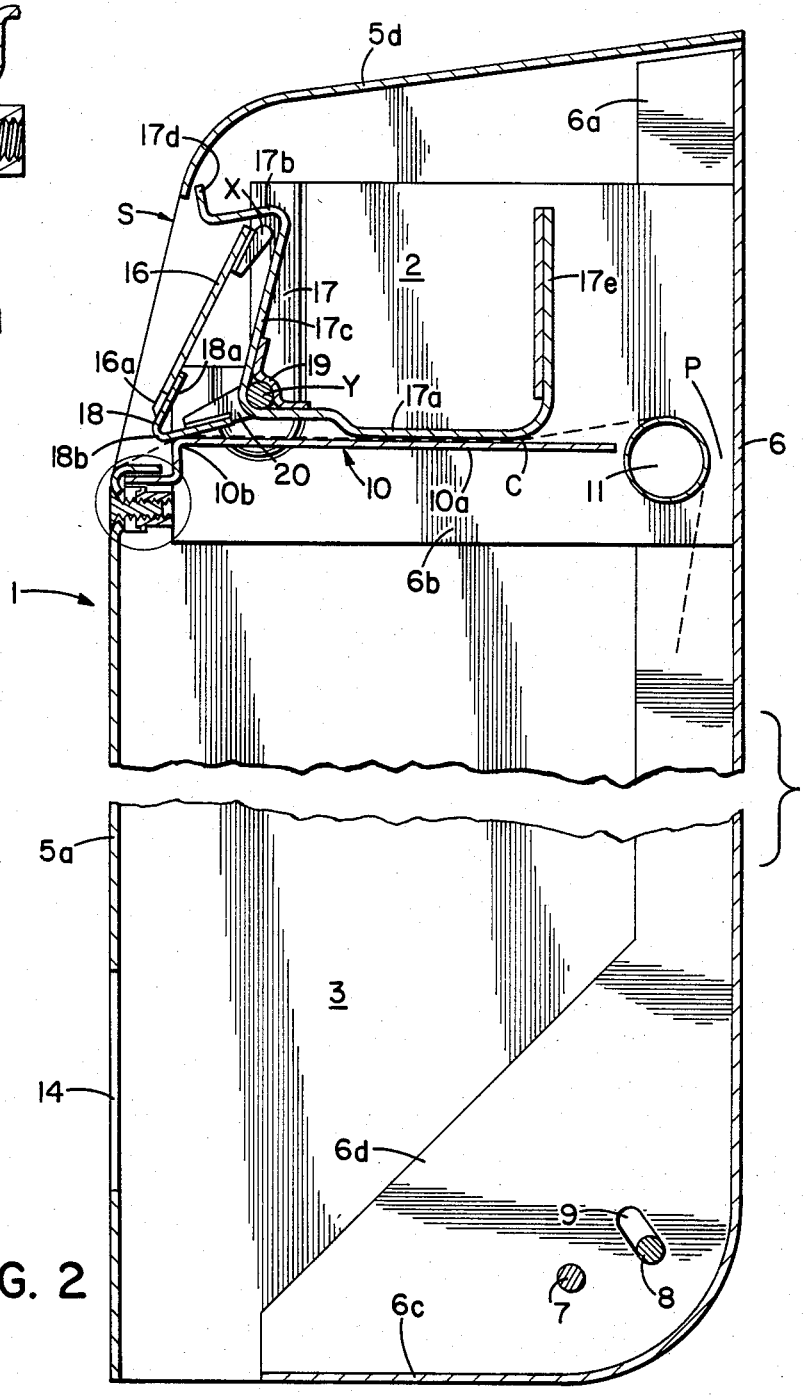
Figure 3:
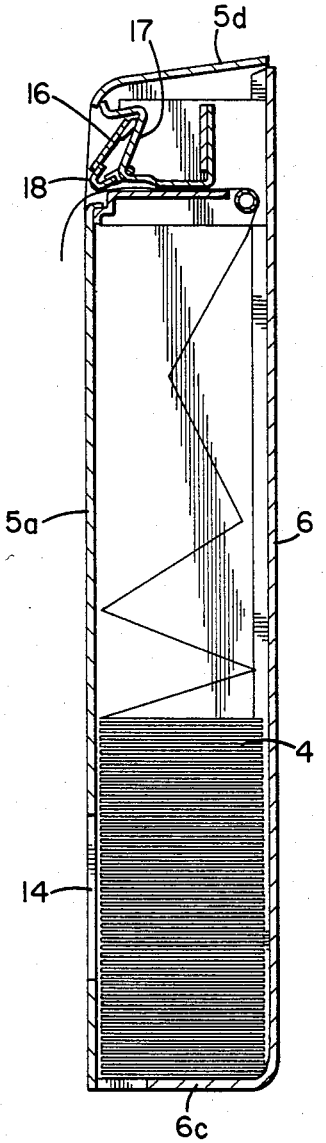
Figure 4:
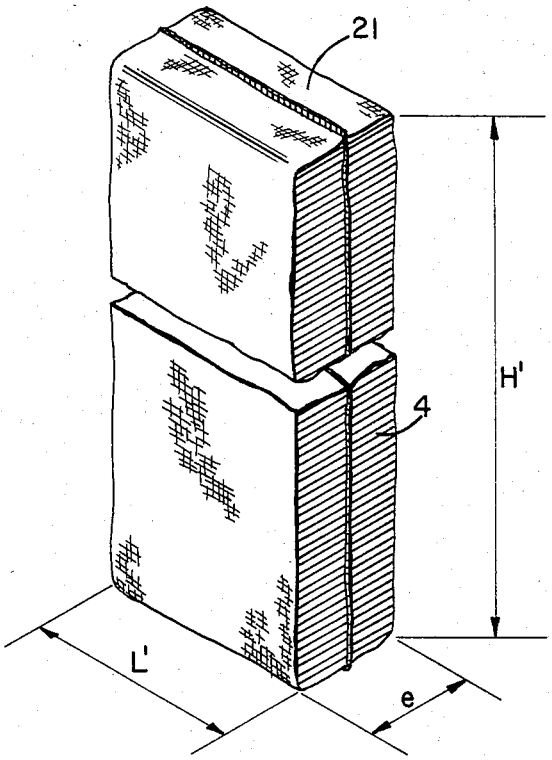
Figure 5:
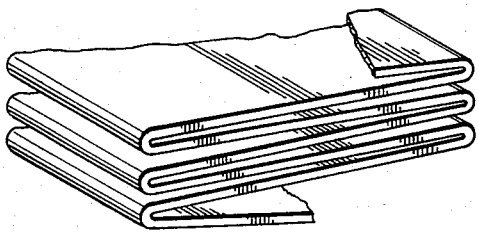

FIG. 1 is a perspective with a partial view of a dispenser of the invention in the open position, FIG. 2 is a partial section through an axial vertical plane, the dispenser being assumed closed and unloaded, the strip motion being schematically indicated by the dashed lines, FIG. 2*a* is an enlargement of the front wall component, FIG. 3 is a section through the same plane showing the loaded dispenser, FIG. 4 is a schematic perspective of a continuous strip to supply the dispenser, FIG. 5 is a detailed view of this strip, and FIGS. 6*a*, 6*b*, 6*c* and 6*d* are schematics illustrating the dispenser operation.

The illustratively shown dispenser of FIGS. 1, 2 and 3 has a high capacity and dispenses lengths of paper used as towels; it can be used in any washroom or the like, public or private, used by a certain number of people.

The dispenser includes a case 1 in the overall shape of an elongated vertical rectangular parallelipiped of a total height H which is about 85 cm and a width 1 of about 25 cm and a depth p of about 11 cm.

This case is provided at the top with a strip-dispensing means 2 which is described further below; below this means 2, the case forms a storage space 3 designed to contain a paper strip 4 of which the width 1' is slightly less than that of the dispenser (about 24 cm) and which is folded in accordion manner with the pleats spaced apart a distance e slightly less than the depth p of the dispenser (about 10 cm).

In the example the storage space of the dispenser is about 70 cm high, whereby an accordion pleated strip of a total length of about 600 m can be stored in it.

The case 1 consists of two parts hinging on each other at the bottom: these are a cross-sectionally U-shaped lid 5 and a rear plate 6 designed to be fastened to a support, for instance a wall. (To simplify the description, hereafter the direction from front to rear is taken as going from the lid 5 toward the plate 6.)

The rear plate 6 along its vertical longitudinal edges is provided with flanges such as 6*a* which are overlapped by the lid 5 in the closed position.

At the top, this rear plate furthermore is provided on either side with bearing plates such as 6*b* which are riveted to the flanges 6*a*. These bearing plates are housed near the side walls of the box when it is closed and keep in place the essential components of the dispensing means 2, as discussed below.

At the bottom, the rear plate 6 is provided with a right-angle support 6*c* supporting the strip 5 in the storage space, and with two lower side bearing-plates 6*d* fastened on either side of said right-angle support 6*d* and to the flanges 6*a*.

The lid consists of a front wall 5*a*, two side walls 5*b*, 5*c* and an upper wall 5*d* closing the box at the top. The front wall is provided at its bottom with a transparent material window 14 that immediately indicates to the maintenance man whether the dispenser must be reloaded.

The lid hinges at its bottom on a shaft 7 on the bearing plates 6*d* so it can pivot forward as shown in FIG. 1. A rod 8 connects its side walls 5*b* and 5*c* and passes through apertures in the shape of circular buttonholes 9 in the bearing plates. These apertures 9 and the rod 8 act as stop means for the angular motion of the pivoting box 5 with respect to the rear plate. The lengths of the apertures 9 are designed to allow the lid 5 to pivot by an angle of about 10°, so that the storage space 3 can be easily loaded in the open position.

The front wall 5*a* of the lid comprises at its top a passageway S in the shape of a rectangular slit extending directly below the upper wall 5*d* of the case across the entire width of the front wall 5*a*. This slit is located in a rising plane, that is in a vertical plane or one sloping up to 30° with respect to the vertical.

The dispensing means of the strip are described below assuming the box is closed so as to specify the position of the components with respect to the passageway S.

A guide wall 10 is mounted between the bearing walls 6*b* which are rigidly joined to the rear wall 6, and it is associated at the rear with strip guide means consisting in this example of a tube 11 fastened between the bearing walls; this guide tube is arranged facing the rear plate 6 to bound a transport space P of the strip between the storage space 3 and the dispensing means 2.

The guide wall 10 includes a substantially horizontal inside zone 10*a*, a sill 10*b* located near the passageway S close to its lower edge, and at the front, a lip 10*c* stretching downward beyond this sill. The lip 10*c* supports a threaded sleeve 11 which receives a tamper-proof component 12 at the front wall 5*a* on the lip 10*c*. In this example, the wall 5*a* comprises a milled-edge hole 13 facing the sleeve 11; the fastener 12 consists of a flat headed screw housed in the milling of the hole 13; a clearance in the screw head allows moving it by a special key 15.

Three blades hinge between the bearing plates 6*b*: a cutting blade 16, a first auxiliary blade 17 and a second auxiliary blade 18; these blades stretch from one bearing plate to the other and substantially, within play, across the entire width of the lid 5 and its passageway S in order to define the latter.

The cutting blade 16 hinges about a transverse shaft X by means of two cylindrical studs on either side of its upper edge. (The expression "transverse" means within the present application a direction along the width 1 of the box).

The hinge shaft X of the cutting blade 16 is located near and underneath the upper edge of the passageway S opposite the sill 10*b* of the guide wall 10.

The cutting blade 16 is substantially plane and is provided at its lower edge with a sawtooth cut-out 16*a* acting as the cutter means.

The cutting blade can pivot about the X shaft from a natural rest position wherein it rests by its weight against the secondary auxiliary blade 18 to a cutting position wherein it presses against the first auxiliary blade 17. In the rest position, the cutting blade 16 is located near the plane of the passageway S, whereas in the cutting position it projects toward and outside said passageway.

The first auxiliary blade 17 hinges about a shaft Y which in this example coincides with the hinge shaft of the second auxiliary blade 18. This shaft consists of a transverse cylindrical rod supported on either side by the bracing plates 6*b*. The first blade 17 is fastened to this rod by two brackets 19 while the second blade 18 hinges about said rod by means of small side yokes 20 provided with suitable holes.

The hinge shaft Y of these blades 17 and 18 is offset from the X shaft and is located above and near the guide wall 10 to the rear and near the sill 10*b*.

The first auxiliary blade essentially consists of three segments: a cover section 17*a* on one side of its hinge Y toward the case inside and in contact with the inside zone 10*a*, a stop section 17*b* on the other side of the hinge Y, opposite sill 10*b*, near the upper edge of the passageway S between this edge and the shaft X, lastly a rising junction section 17*c* between the section 17*b* and the section 17*a*.

The stop section 17*b* forms a projection toward the passageway S located above the cutting blade 16 whereby the latter rests against the stop 17*b* when in the cutting position. In this example, the stop section 17*b* is extended by an angled part 17*d* pointing upward in order to entirely seal the passageway S.

The junction section 17*c* is located behind the cutting blade 16 and is connected to the stop 17*d* by an elbow located above and behind the shaft X.

The cover section 17*a* takes the shape of the inside zone 10*a* so as to bound a path C for the strip where this strip is braked by the friction exerted by this section 17*a*; this section 17*a* is provided with a weighted extension 17*e* deviating from the wall 10*a* in order that the entry to the path C be flared and furthermore to allow adjusting the friction caused by the rest of the section 17*a* due to gravity.

Lastly the second auxiliary blade is of a suitable cross-sectional height to come to rest by its own weight on the sill 10*b* (the height of a blade being defined by the distance between its hinge shaft and its farthest extreme edge); furthermore, the height of this blade 18 is much less than that of the cutting blade 16.

This blade 18 also is provided with a side 18*a* extending upward and rearward by means of the insertion of an elbow edge 18*b*. This side assumes an angular direction in such a manner that in the natural rest position, the plane of said side and that of the blade 16 substantially coincide (within material thickness) in the rest position.

The cross-sectional height of the cutting blade 16 is less than the distance between the edge 18*b* of the blade 18 and the hinge shaft X of the cutting blade, for the rest position.

Therefore, in the rest position, the cutting blade 16 rests against the side 18*a* of the blade 18 without exceeding said blade, its cutter means 16*a* abutting the side and being harmlessly retracted against the upper surface of said side.

FIG. 4 shows a strip of the invention; this strip consists of a continuous length of paper (or other suitable material) which is in the accordion folded state; as shown by FIG. 5, the various pleats are substantially superposed in two parallel planes so that the strip assumes the shape of a rectangular parallelipiped. After the strip has been loaded into the dispenser, these planes are located near the rear plate 6 and the front wall 5*a*.

A peripheral control 21, in this embodiment a transparent, flexible plastic envelope, maintains the strip-shape during shipping and storage and prevents it from unfolding.

This envelope is torn open at the top when loading, the strip is then placed into the dispenser storage space and its end is forced into the path C (thanks to a slight pivoting motion of the blade 17) until it comes out between the auxiliary blade 18 and the sill 10*b*. Thereupon the lid 5 can be closed and locked: the dispenser is ready for use.

FIGS. 6*a*, 6*b*, 6*c* and 6*d* illustrate the operation of the dispenser.

Figure 6C:
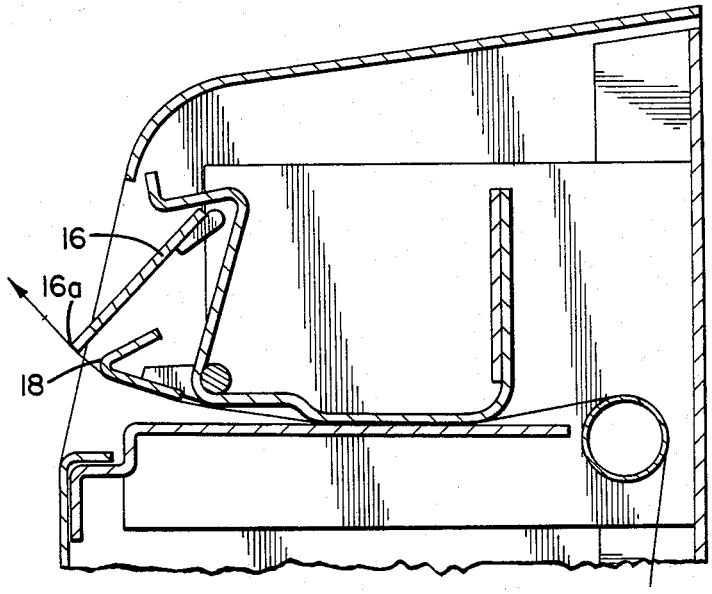
Figure 6D:
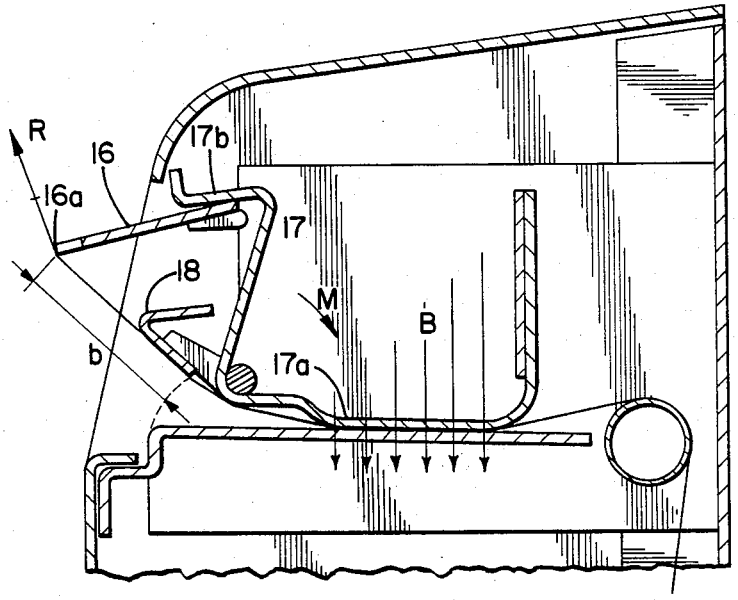
Figure 6A:
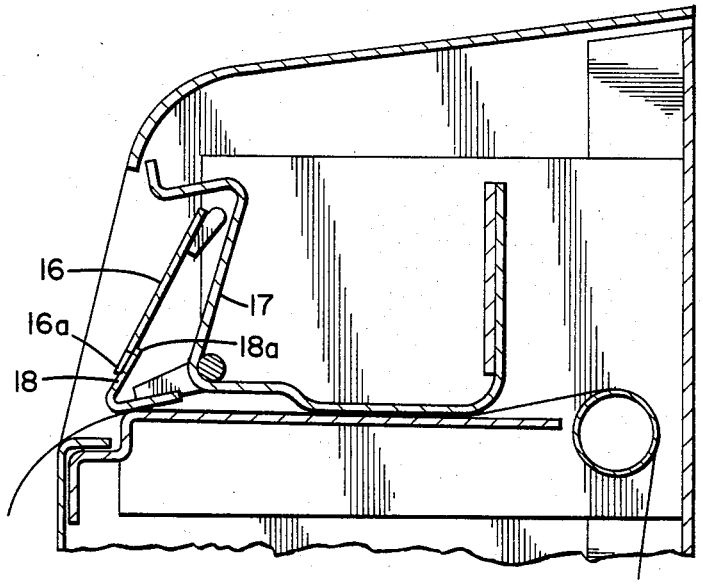
Figure 6A:
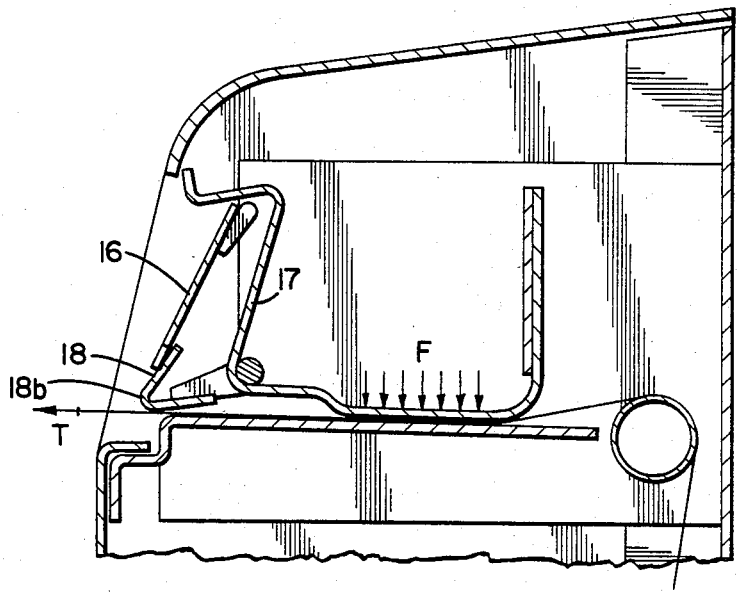

FIG. 6*a* shows the dispensing means at rest. The strip moves between the second auxiliary blade 18 and the sill 10*c* and reaches the outside of the dispenser. The cutting blade 16*a* rests against the side 18*a* without being a danger to the user.

FIG. 6*b* is a schematic of the strip-dispensing stage: the user exerts a continuous moderate pull T on the end of the strip; this strip is braked by the first auxiliary blade 17 and is dispensed uniformly without danger of tearing or waste. Depending on the direction of T, the blade 18 either stays in place or is slightly lifted.

FIG. 6*c* illustrates an intermediate position of the dispensing means when the user initiates an upward traction on the strip before coming to the severing position. The blade 18 progressively lags behind the cutting blade until the strip makes contact with the cutters 16*a* which then are projecting in front of the passageway S.

Lastly FIG. 6*d* illustrates the severing position: the user applies a sudden rupturing upward tension R; the cutting blade 16, resting against the first auxiliary blade 17, transmits to same a moment M whereby a locking stress B is applied to the cover section 17*a*. The strip is locked at that location and the tension R causes a clean cut of the strip where it touches the cutters.

It should be noted that an excess b is retained at the end of the strip, this length b allowing to easily grip it when dispensed next. Furthermore the presence of the three blades and their arrangement eliminate any chance of losing a hold on the strip because preventing the paper from being forced back inside voluntarily or accidentally.

The above described dispenser illustratively includes its own case; as a variation and in some circumstances the dispenser case may consist of a housing in a pre-existing structure (in particular in vehicles or aircraft).

I claim:

1. A dispenser for continuous, severable strips, in particular paper strips, comprising:

a case (1) for holding said strip including a passageway (S) for the end of said strip, a guide wall (10) in said case near the passageway (S) and having an inside zone (10*a*) extending into the case and a sill (10*b*) at the exit of this case at the edge of the passageway (S), a cutting blade (16) having cutter means (16*a*) and being hinged near the passageway (S) about a shaft (X) for allowing said cutting blade to pivot between a natural rest position adjacent the plane of said passageway and a cutting position wherein said cutting means (16*a*) projects through the plane of the passageway, a first auxiliary blade (17) hingedly mounted on a shaft (Y) adjacent said passageway (S), said first auxiliary blade including a cover section (17*a*) extending from one side of its hinge (Y) into the case and contacting the inside zone (10*a*) of the guide wall to bound a path (C) for the strip and a stop section (17*b*) arranged on the other side of its hinge (Y) whereby the cutting blade (16) when in the cutting position abuts against said stop section (17*b*) under pressure and in the natural rest position of the cutting blade (16), said cover section (17*a*) rests against the guide wall (10) for braking the strip in the path (C), and so that in the cutting position of said cutting blade (16) said auxiliary blade (17) is subjected by the pressure exerted on said stop section (17*b*) to a moment (M) so that said cover section (17*c*) pinches and locks the strip within the path (C), a second auxiliary blade comprising a protection section (18*a*) for said cutting means (16*a*) of said cutting blade and being , this second auxiliary blade hinged about a shaft (Y) offset from the shaft of said cutting blade (16) in order to pivot between a natural rest position corresponding to the natural rest position of the cutting blade (16), wherein said auxiliary blade (18) is near the sill (10*b*) of the guide wall and acts as a support to the cutting blade (16), the cutting means (16*a*) of said cutting blade (16) being withdrawn against the protection section (18*a*) of said auxiliary blade (18), and a retracted position corresponding to the cutting position of the cutting blade (16) wherein said auxiliary blade (18) is behind said cutting blade and said cutting means.

2. A strip dispenser as in claim 1, characterized in that:

said cutting blade (16) is hinged about a shaft (X) near one edge of the passageway (S) opposite the sill (10*b*) of the guide wall of the case, said second auxiliary blade (18) is hinged about a shaft (Y) near the sill (10*b*) of the guide wall;

said second auxiliary blade (18) having a cross-sectional height less than the cross-sectional height of the cutting blade, said cutting blade (16) having a cross-sectional height less than the distance between the end edge (18*b*) of the second auxiliary blade and the hinge shaft (X) of the cutting blade in its rest position.

3. A strip dispenser as in claim 2 characterized in that:
said cutting blade (16) is substantially planar and said cutting means (16*a*) comprises a saw-tooth cut-out on its end edge,
said second auxiliary blade (18) having a side (18*a*) located in a plane essentially coinciding with the plane of said cutting blade (16) in the natural rest positions of said blades.

4. A strip dispenser as in claim 3, characterized in that:
said stop section (17*b*) of said first auxiliary blade extends near one edge of the passageway (S) opposite the sill (10*b*) of the guide wall and forms a projection, pointing toward the passageway, located between said edge of said passageway and the hinge axis (X) of said cutting blade.

5. A strip dispenser as in claim 4, characterized in that said first auxiliary blade (17) hinges about a shaft (Y) coinciding with the hinge shaft of the second auxiliary blade (18).

6. A strip dispenser as in claim 5 and wherein said passageway (S) has a generally rectangular shape, and said cutting blade (16), said first auxiliary blade (17) and said second auxiliary blade (18) are substantially as wide as said passageway so as to seal said passageway and hinge about transverse shafts (X, Y) extending in the direction of the width.

7. A strip dispenser as in claim 6 and wherein the passageway (S) is located in a rising plane when in the position of use of said dispenser, characterized in that:
said guide wall (10) is essentially horizontal and said sill (10*b*) is adjacent the lower edge of the passageway,
said second auxiliary blade (18) being hinged above and near the guide wall (10) behind the sill (10*b*) and being adapted to come to rest by its own weight when in its natural rest position on the sill (10*b*),
said cutting blade (16) being hinged near and above the upper edge of the passageway (S) and being adapted to rest, when in its natural rest position, by its own weight against the second auxiliary blade (18),
said first auxiliary blade (17) being hinged about said shaft (Y) which it shares with the second auxiliary blade and including a rising section (17*c*) joining its cover section (17*a*) and its stop section (17*b*), said rising section (17*c*) being at the rear of the cutting blade (16) and connected to the stop section (17*b*) above and behind the hinge shaft (X) of the cutting blade, said stop section (17*b*) forming a projection toward the passageway (S) above the cutting blade (16).

8. A strip dispenser as in claim 7 and wherein said cover section (17*a*) of the first auxiliary blade has a shape matching that of the inside zone (10*a*) of the guide wall and is provided opposite the passageway (S) with a weighted extension (17*e*) deviating from said guide wall.

9. A strip dispenser as in claim 8 and wherein said case (1) includes a storage space (3) underneath the guide wall (10) to hold an accordion folded strip (4).

10. A strip dispenser as in claim 9, characterized in that said case (1) has the overall shape of a vertical, elongated rectangular parallelipiped, the passageway (S) being in the shape of a rectangular slit near the upper end of the case and across the entire width of one side of said case.

11. A strip dispenser as in claim 10, characterized in that the case (1) comprises a rear plate (6) for being fastened to a support and a lid (5) having a U-shaped cross-section provided with a front wall (5*a*) and two side walls (5*b*, 5*c*) for covering said rear plate (6), said lid (5) being hinged at the bottom of the rear plate so that the case can be opened by pivoting the lid for the purpose of loading, and angular excursion stop means (8, 9) associated with said lid (5) for limiting its pivotal motion with respect to the rear plate (6).

12. A strip dispenser as in claim 11, characterized in that:
said passageway (S) is located in the front wall (5*a*) of the lid (5) at its upper part,
said cutting blade (16), said first auxiliary blade (17) and said second auxiliary blade (18) being hinged on bearing plates (6*b*) fastened on either side of the rear plate (6),
said guide wall (10) being fastened between said bearing plates (6*b*) and being provided at its rear part with guide means (11) for the strip which are arranged opposite the rear plate (6) to bound a space (P) as a strip path at the exit of the storage space (3).

13. A strip dispenser as in claim 12 and wherein said guide wall (10) extends beyond its sill (10*b*) by a downward lip (10*c*) and includes a tamper-proof fastener (12) for the front wall (5*a*) of the lid.

* * * * *